US006048268A

United States Patent [19]

Humble

[11] Patent Number: 6,048,268

[45] **Date of Patent: *Apr. 11, 2000**

[54] ELECTRONIC PROMOTIONAL GAME

[75] Inventor: David R. Humble, Deerfield Beach, Fla.

[73] Assignee: Advanced Promotion Technologies, Deerfield Beach, Fla.

[ * ] Notice: This patent is subject to a terminal disclaimer.

[21] Appl. No.: 07/862,067

[22] Filed: Apr. 2, 1992

[51] Int. Cl.[7] ..... A63F 9/22

[52] U.S. Cl. ..... 463/17; 463/16; 273/139

[58] Field of Search ..... 273/138 R, 138 A, 273/139, 269, 460, DIG. 28; 235/375, 462; 463/17, 16

[56] References Cited

U.S. PATENT DOCUMENTS

| | | | |
|---|---|---|---|
| 3,852,576 | 12/1974 | Rudd | 273/138 A |
| 4,573,954 | 3/1986 | Berger et al. | 273/139 |
| 4,854,590 | 8/1989 | Jolliff et al. | 273/138 A |
| 4,993,714 | 2/1991 | Golightly | 273/138 A |
| 5,042,809 | 8/1991 | Richardson | 273/138 A |
| 5,091,634 | 2/1992 | Finch et al. | 235/375 |
| 5,092,598 | 3/1992 | Kamille | 273/139 |
| 5,128,520 | 7/1992 | Rando et al. | 235/375 |
| 5,129,652 | 7/1992 | Wilkinson | 273/139 |

FOREIGN PATENT DOCUMENTS

| | | | |
|---|---|---|---|
| 2123702 | 2/1984 | United Kingdom | 273/138 A |
| 2147773 | 5/1985 | United Kingdom | 273/138 A |

OTHER PUBLICATIONS

"Employee Motivation" article (no author), *Incentive* Nov. 1991 pp 35–38, 91.

*Primary Examiner*—Jessica Harrison
*Assistant Examiner*—M. O'Neill
*Attorney, Agent, or Firm*—Lott & Friedland

[57] ABSTRACT

An electronic promotional game which preferably operates in conjunction with a point of sale terminal having a processor includes an electronic display screen for displaying the image of a game card. The game card has one or more selection areas which appear initially to be covered by an opaque covering which conceals game information on the card, specifically the indicia which indicates a winning game card or the premium to be awarded. An input device allows the game participant to control substitution of the game information for the opaque covering in the image, thus simulating erasure of the opaque covering in the manner of a scratch-off paper based game. The input device can include a touch sensitive screen for indicating the position to be "erased" on the image. The processor controlling the display is preferably coupled to a keyboard or product code scanner which enters the product values or the product identities, and the processor preferably selects prizes, and/or varies the odds of winning a prize, as a function of the identity of products purchased by the participant or their dollar value.

4 Claims, 3 Drawing Sheets

ELECTRONIC PROMOTIONAL GAME

BACKGROUND OF THE INVENTION

1. Field of the Invention

The invention relates to the field of electronic display systems including input means, wherein a game is displayed on a video screen. More particularly, the invention concerns an electronic promotional game system having a processor controlling a presentation on a display, wherein the image of a promotional game card having a concealed indicia is displayed and, in conjunction with an input means coupled to the processor, a player can cause the concealing layer to be "rubbed off" to reveal the indicia.

2. Prior Art

Games involving forms having indicia concealed under an opaque layer which can be rubbed off by the player are known for use by merchants as promotional items. These games increase consumer purchases and generate consumer product awareness which leads to increased sales. The promotional rub off games typically provide a card or ticket made of paper or card stock, with indicia indicating a winning ticket printed on the ticket, perhaps under a release layer of varnish. At least one, and possibly a number of selection areas bearing the indicia are covered with a removable opaque material such as a rubberized paint. A game participant, typically a consumer who purchases a specified product or visits a participating retailer, is given one of the game cards. Neither the issuing retailer nor the customer can distinguish a winning game card from others until the concealing layer is removed. The participant removes the opaque material from one or more of the selection areas according to the promotional game instructions, typically by rubbing the selection area with the edge of a coin or other hard object, to reveal the underlying indicia. Losing tickets are discarded. Winning tickets are presented by the participant to the retailer when claiming the indicated prize, usually a product which the retailer wishes to promote, but also possibly a cash prize or the like.

The concealed indicia may designate prizes which are awarded immediately, or may designate an award in cash or other prizes after mailing in a winning ticket. Generally, an assortment of individual tickets are produced, bearing different symbols or sets of symbols hidden in their selection areas. However, each participant has an equal chance of winning a prize because the game tickets are distributed randomly and the symbols indicating the prizes cannot be observed until the opaque material has been removed from the selection areas. Such promotional games can generate substantial excitement, particularly where the at least one of the many game cards issued designates a very valuable prize, and the issuing retailer makes this known by advertising. From the retailer's standpoint, the object of such games is to bring consumers into the store, and to promote the sale of products by giving customers the chance to sample products designated on winning tickets.

It would be desirable for a manufacturer or retailer to be able to vary the character of a promotional game of this type, without the substantial pre-planning which would be necessary to arrange for different supplies of concealed-indicia tickets. For example, a retailer may wish to promote different products at different times by awarding them as prizes. Another possibility is to vary the odds of winning a prize or the value of the prize, based upon the type and/or value of products purchased by a consumer, thereby providing additional incentive for customers to make purchases which are relatively more profitable to the retailer. Heretofore, it may have been possible to produce different sets of tickets which award different products or other prizes. However, this is unwieldy. A method or apparatus for varying the prizes and/or the odds of winning a prize based upon a specific consumer's purchase has not been possible because the indicia designating winners is, by definition, concealed. It is not possible to selectively distribute game tickets when the winning tickets are concealed and randomly distributed in a group of tickets.

It would be possible to label the tickets in a concealed-indicia game with some visible indication of the value of the ticket (or at least the potential value if the ticket is a winner), allowing the more valuable tickets to be distributed selectively. However, the labelling technique would likely become general knowledge. The label would take much of the excitement out of the game in that persons with tickets which lacked the indication of value would have no hope of winning the "big prize". Even if the labelling technique did not become generally known, unscrupulous clerks who were aware of the technique could identify the more valuable tickets and would have an incentive to distribute them to favored persons or in a manner which was not strictly related to the value of a customer's purchase. If the variable pay-back (e.g., odds or prize value) were to include a plurality of levels, the labelling technique could be complex and confusing, particularly as it would theoretically be arranged so as to be difficult for a consumer to discern. Therefore, a variable pay-back game of this type has not been possible or practical.

The present invention overcomes these problems by providing an electronic promotional game which simulates a rub-off game card, permitting the indicia behind the concealing layer to be varied via software. The invention displays the image of a concealed-indicia game card on a video screen and has input means controlled by the participant such that the participant can electronically erase the image of concealing "opaque" layer to reveal the indicia on the simulated game card. The promotional game is preferably coupled to a checkout terminal or product code scanner which determines the particular products purchased and/or the dollar value of purchases by a consumer. The award indicia on the game card displayed to the consumer thereby can be varied to change the prizes or the odds of winning a prize based upon the particular products purchased, the value of a purchase, or even the buying history of the particular consumer who may be identified by means of an account number, money-access card or the like. Whereas the tickets are generated and varied among customers via programming, it is also readily possible to change the character of the prizes, to enable the merchant to promote different products at different times, and otherwise to operate a versatile promotional program, with none of the drawbacks of known rub-off games as discussed above, and with even more of their benefits.

SUMMARY OF THE INVENTION

It is an object of the invention to provide a versatile and effective means for promoting consumer purchases.

It is another object of the invention to provide a promotional game which eliminates paper game cards in order to reduce paper trash and litter.

It is a further object of the invention to provide a promotional game which permits variation of the prizes to be awarded or the odds of winning, based upon products purchased or the value of products purchased by a consumer.

It is still another object of the invention to provide a promotional game of this type which can be readily altered by the operator, without the need to generate a new supply of game entry tickets.

It is a further object of the invention to provide a promotional game system which selects and awards premiums to purchasers based on at least one of the nature of products purchased, the value of products purchased, and the buying history or profile of the purchaser.

These and other objects are accomplished by an electronic promotional game comprising a video screen and means for generating an image of a game card for display on the video screen. The image of the game card defines one or more selection areas for display of indicia representing a winning or losing game entry; however an apparently opaque layer appears in the selection areas initially. Input means are provided for allowing a participant to electronically "erase" one or more of the apparently opaque layers in the video image, by controlling substitution of the image of the indicia for the image of the opaque layer.

The means for electronically erasing may include, for example, a video touch screen or a keyboard or other switching means coupled to a processor which generates or reads out video data from memory. Preferably, the opaque layer is substituted by the indicia in an area-by-area progression, in the same manner that a player of an actual rub-off game would scrape the opaque covering from a game card. When a selected portion of the concealing layer in the video image is erased, a symbol such as a word, sentence, logo or drawing, which may or may not designate a prize, is displayed in the selection area.

The processor preferably is programmed to award prizes on a random basis, for example selecting a symbol from a list of potential stored symbols using a random number generator. The absence of a displayed win symbol in the erased selection area can be used to indicate that a prize has not been won or a different symbol can be selected (e.g., "Better luck next time").

The invention also may include product code scanning means or other data entry means for determining particular products purchased by a consumer, the dollar value of the products purchased by the consumer, the consumer's identity, etc. The selection of available prizes may be changed by the processor as a function of the products purchased by the consumer, the value of a purchase or the consumer's history of relations with the store. Also, the odds of winning a prize may be varied according to similar criteria. The invention thus provides a promotional program which can favor those customers who are most profitable for the establishment, as well as a program which is readily changed with respect to the prizes awarded, the means by which the prizes are chosen, and other aspects of the game.

BRIEF DESCRIPTION OF THE DRAWINGS

There are shown in the drawings exemplary embodiments of the invention as presently preferred. It should be understood, however, that the invention is not limited to the exemplary arrangements and instrumentalities shown in the drawings, and is capable of variations in accordance with this disclosure and the appended claims. In the drawings.

DETAILED DESCRIPTION OF THE PREFERRED EMBODIMENTS

An electronic promotional game according to the invention includes a processor which controls a display shown to the customer, and input means operated by the customer for simulating the removal of an opaque coating from a rub-off game card, to reveal a concealed indicia which may represent a premium to be awarded to the customer. The processor is programmed to select from memory the indicia which is displayed as the opaque coating is removed from the displayed image. The processor simply substitutes the concealed image for the coating image under control of the input means; however the consumer perceives the process as scratching an opaque coating from a game card in a manner similar to scratching a coating from a paper game card.

Preferably, the processor selects the indicia representing the premium adaptively, for example as a function of the nature or value of products which the customer presents for purchase. The invention is thus especially adapted for a retail checkout station wherein scanning equipment is coupled to a processor for reading Universal Product Codes (UPC) or other bar code data on items being purchased by a consumer. Whereas the nature and value of the products is thus determined by the processor, the premium awarded to the customer can relate to the products or their value.

Figure 1:
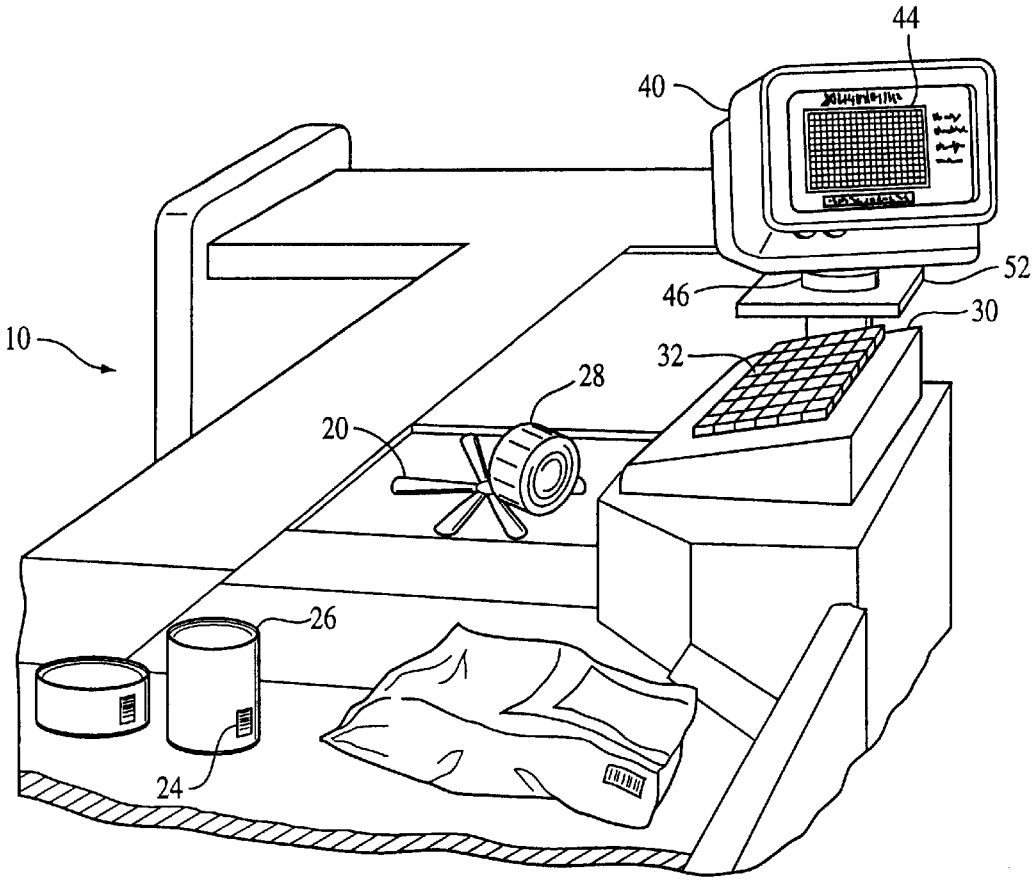
FIG. 1 is a perspective view of a retail store checkout station having equipment for an electronic promotional game according to the invention.
Figure 5:
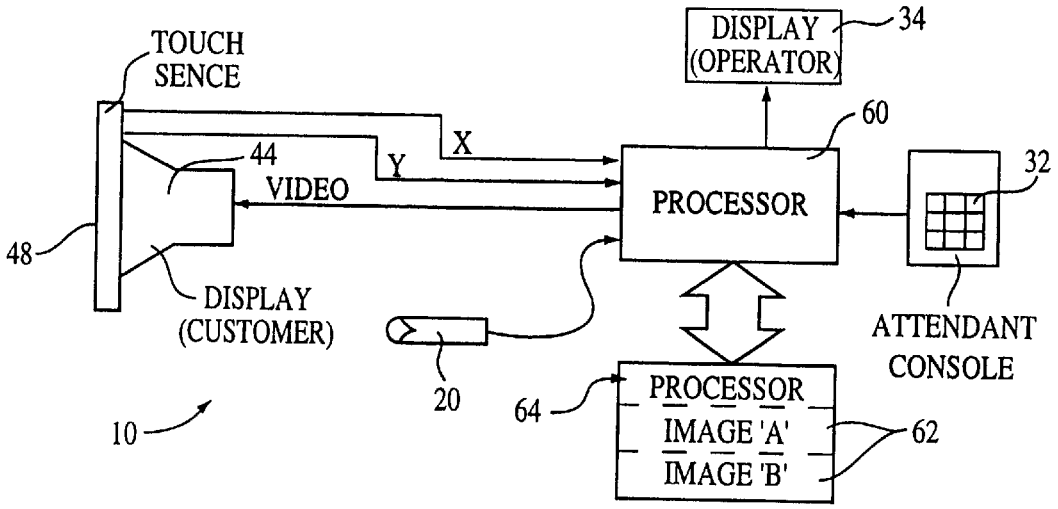
FIG. 5 is a schematic block diagram illustrating the electrical couplings and data processing arrangements according to the invention.

As shown physically in FIG. 1 and via schematic block diagram in FIG. 5, a checkout station shown generally as 10 includes a scanning means 20 for reading bar code 24 on items presented for purchase, exemplified in the FIG. 1 by cans 26, 28, etc. Can 28 is shown disposed over the scanning means 20 as required for the scanning means 20 to read the bar code 24 on the can 28. The data represented by the bar code is input to the processor 60, which can be the same processor that accomplishes usual checkout functions including, for example, input of data from an operator's keyboard 32, display of data on an operator's display 34, totalling the purchase, printing receipts, etc., as is well known in the art. The scanning means 20 can be hand held or mounted in the checkout counter. A counter-mounted model typically emits a laser beam which is swept over the bar code using a rotating mirror built into a panel in the counter, and the reflection of the beam is sensed by the scanning means 20 to produce a time-varying signal as a function of alternating light and dark lines, spaced at varying intervals to represent a numeric code. Other forms of scanners are also known, such as handheld wands and miniature laser scanners. The processor 60 in conjunction with the scanning means 20 reads the numeric code and determines from a look-up table in a memory 64 coupled to the processor at least the price to be charged. Various information concerning the items being purchased, such as description, weight, size, promotional status and the like can be associated in the processor's memory 64 with particular product codes. The usual procedure for a checkout processor includes referencing the product code information to price and description data indexed against the product code and stored in memory, printing a receipt showing the price and description to be given to the consumer, and keeping a running total.

According to the invention, a processor 60 additionally operates a display which is visible to the customer, choosing and displaying the indicia of the promotional game. This is preferably the same processor 60 that operates the other checkout functions; however, it is possible to couple an additional processor to the checkout processor provided at least the value of the transaction is communicated to the processor operating the customer display device 44.

The displayed image of the game card can be standardized, or if desired a different card image can be displayed at different times, each available card image being stored in the processor's memory 64 in digital form. The indicia which represents a premium award, however, is changeable. To enable the processor to choose a particular premium award as a function of the products presented for purchase, the product code information can be indexed to information in the processor memory respecting the premium status of particular products. Alternatively, the decision can be based simply on product price or total transaction amount, in which event sufficient data can be obtained simply by product price data entered by the checkout operator rather than by scanning UPC codes.

The checkout station 10 includes a key operated control console 30 having keys 32 which are operable by store personnel for data input. The keys 32 permit the store personnel to input price or code information when a UPC code is not present or is damaged such that the scanning means 20 does not successfully read the bar code 24. The keys 32 can also be used with operation of a cash drawer enabling the store personnel to enter and deposit cash tendered by a customer and to display and provide change to the customer, on one or both of the operator's display 34 and the customer's display 44.

A customer's video console 40 having a video screen 44 is provided at the checkout station 10 and oriented for viewing by a customer. Preferably, the video console 40 is rotatably mounted on base 52 via swivel joint 46. The video screen 44 can be the illuminated viewing surface of a cathode ray tube. Alternatively, the video screen 44 may comprise a liquid crystal display, gas discharge display or other suitable light emitting or light reflecting source.

Figure 2:
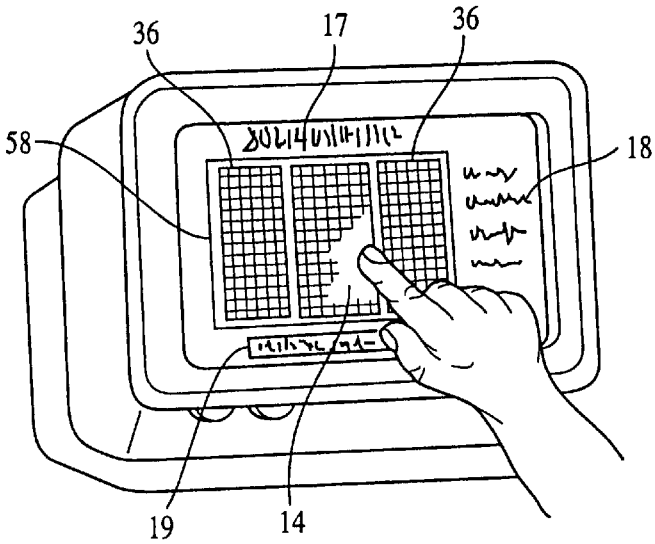
FIG. 2 is a perspective view of an electronic game card displayed on a video screen for the electronic promotional game according to the invention.

Referring now to FIG. 2, according to the invention, an electronic game card 58 is displayed on the video screen 44 under control of the processor. The electronic game card 58 has a plurality of selection areas 36 each defined by an image section simulating an opaque covering over information concealed below. For example, the "opaque" video image can be provided by illuminating the entire selection area 36 with a matte color or pattern.

The game display can be commenced at the end of a transaction or during the transaction. The customer operates input means associated with the display and coupled to the processor operating the display, to guide a pointer or cursor over the selection areas. The processor is programmed to substitute the image of indicia representing game information (e.g., a premium to be awarded) for the image of the opaque covering, under the customer's control from the input means. The invention thus provides a means for electronically simulating manual erasure of at least one of the opaque covering areas of the video image, as the initially displayed image of the covering, for example image 'A' in memory, is substituted by the image of the concealed data, for example image 'B' in memory.

As shown in FIG. 2, the input means for enabling the customer to electronically erase the opaque covering may be a video touch screen sensor 48, light pen or the like. In a touch screen sensor device, the customer applies slight pressure to the screen with a finger, or alternatively the customer can bring a light pen into proximity with the sensing means on the display. In either case, a signal is developed indicating an X-Y position on the screen as selected by the input means, and as known in the art of video displays. When this input is detected, the processor substitutes the concealed image for the covering image in that area. As the customer moves the position indicator about on the screen, the processor continues to substitute the concealed indicia for the covering at the indicated position, thus proceeding to "erase" the covering over an area 14 and by revealing the premium indicia image as the customer progressively covers the selected area of the screen.

Figure 3:
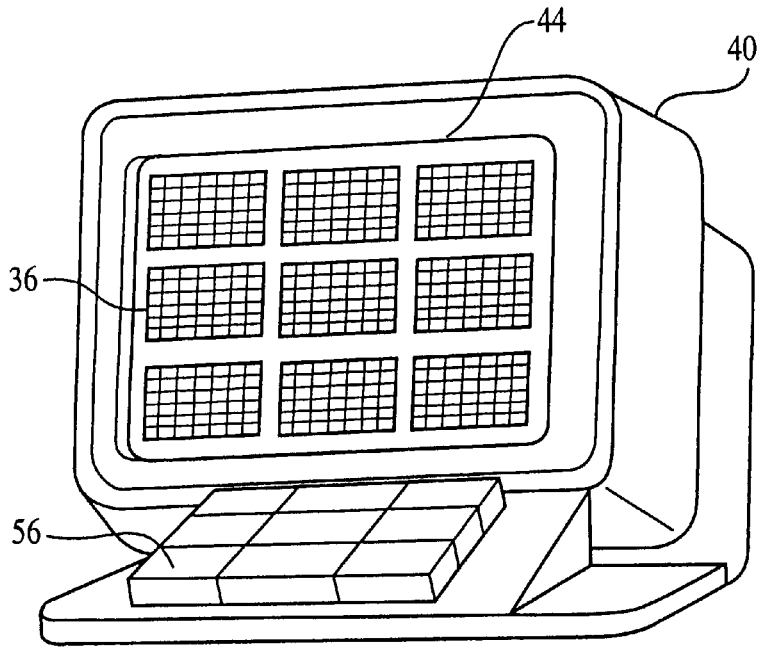
FIG. 3 is a perspective view of an alternative embodiment for an electronic game card and video screen for the electronic promotional game.
Figure 4:
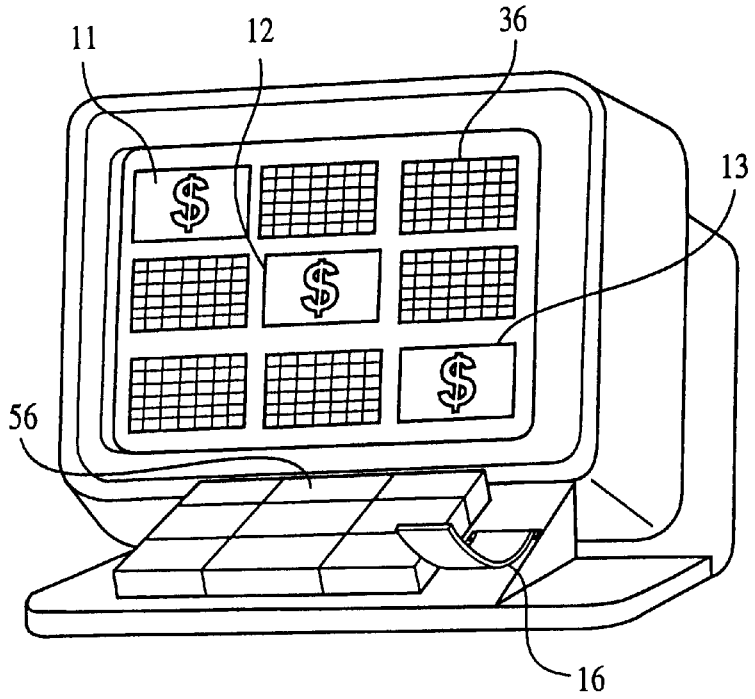
FIG. 4 is a perspective view of a video screen having means for providing a printed receipt for the electronic promotional game.

The input means is preferably a touch sensitive screen device or stylus which the customer operates. It is also possible to use other forms of position indicators involving a cursor or pointer which the customer moves about, such as a mouse or joystick. In an alternative embodiment as shown in FIGS. 3 and 4, the means for electronically erasing includes a plurality of keys 56 in electronic communication with the processor generating the signal for display on video screen 44 and arranged in an array corresponding to the arrangement of the selection areas 36 on the video screen 44. In order to erase the opaque video image in one of the selection areas 36, the consumer depresses the key 56 which has a position in the array corresponding to the position on the video screen 44 of the selection area 36 which the consumer desires to select. Alternatively, the keys can indicate directions in which the cursor is to be moved while erasing the covering image.

The processor includes memory for storing the covering image and all of the underlying indicia which may be displayed. These images are simply copied into a video buffer memory associated with the processor. Various games are possible. A tic-tac-toe form of game is illustrated in FIG. 4, wherein the customer has selected for erasure three selection areas 11, 12, 13 to reveal dollar signs ("$") In such a game, the customer is required to correctly guess which of the selection areas hold concealed dollar signs, in order to qualify for a premium. The video symbols may be any suitable word or mark, and may or may not be provided in patterns. The symbols can be provided only under winning selection areas, other areas remaining blank when erased, or different symbols can be provided in different areas for providing various combinations of premium win selection.

The electronic promotional game according to the invention can be used to operate many of the known concealed-indicia promotional games offered on printed tickets by retailers to their customers. The known promotional games are provided in a multitude of embodiments each with different rules. Such games may provide one or many selection areas covered by an opaque material, and the rules may provide for the game participant to rub off the opaque material from only one or a number of the selection areas, or perhaps all of the selection areas. For example, as shown in FIG. 2, the participant removes the opaque video image from any one of the three selection areas 36. In an alternative example, as shown in FIG. 4, the participant removes the opaque video image from any three of the nine selection areas 36. Predetermined ones of the video symbols designate a prize. As shown in FIG. 4, a prize may be designated by three video symbols in the selected pattern being the same.

The apparatus of the invention can operate in conjunction with a point of sale terminal operated by store personnel, or can be automatic. When the electronic promotional game designates a prize, the participant may receive a printed receipt 16 which describes the prize or gives instructions for claiming the prize. Alternatively, the award can be built into the operation of the checkout, by deducting from the total charged to the customer a variable premium award.

According to the invention, the nature of the electronic game and/or the premiums offered as prizes can be readily changed because they are programmed into the instructions of the processor which operates the display. The particular electronic game card which is displayed to the customer is preferably varied under control of the processor according to the nature or value of the items purchased by the customer. A plurality of images corresponding to the games, premiums, odds of winning and the like can be readily stored in sections 62 of the processor's memory 64. The nature of the items can be determined from the scanning means 20 at the checkout station 10, and the value determined from the lookup table indexed to the product codes. Alternatively, the processor can base the choice of game or premium simply on the value of the items presented, as detected either from the scannable code or from information entered by an attendant on keyboard 32. For example, a particular game card may be displayed when a consumer purchases a particular product. Also, the value of prizes potentially awarded in the electronic promotional game can be varied according to the total dollar value of purchases made by the consumer. Further, the odds of winning a prize can be varied according to the particular products purchased by the consumer or the total dollar value of products purchased. The odds can be adjusted by providing the electronic game card with a greater proportion of prize-winning video symbols, by varying the percentage of game-winning electronic game cards which are displayed to all of the consumer participants in the game, etc. These parameters are readily accomplished by programming of the processor, for example using random number generation routines which are weighted by the product or transaction values. As shown in FIG. 2, the video screen 44 may also include information displays 17, 18, 19 for displaying information to the participant such as the name of the game, instructions for playing the game, prizes which can be won, and odds of winning a prize.

The invention has the advantage of permitting a manufacturer or retail to promote the purchase of certain products by offering consumers a chance to win a prize whenever a particular product is purchased. The invention also has the advantage of enabling a retailer to promote sales by offering a promotional game having prizes which are enhanced in correspondence with the value of the products purchased. The invention has the further advantage of eliminating printed tickets which present rubbish and disposal problems, and providing an electronic promotional game which is fully as fascinating and exciting for the participant as games which are based on printed tickets.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples is order to assess the scope of the invention in which exclusive rights are claimed.

I claim:

1. A checkout terminal including an electronic promotional game, comprising:

a display screen;

means for displaying an electronic game card on the display screen, the electronic game card having at least one selection area defined by a simulated opaque image;

a processor having a memory, the processor being operable for substituting a selected area of the simulated opaque image with a corresponding area of indicia representing game information in an area-by-area progression, thereby electronically simulating progressive erasure of the simulated opaque image to reveal the game information; and, input means coupled to the processor for entry of data representing at least one of a value and an identity of products presented for purchase;

wherein the processor is operable to select from the memory particular indicia to be displayed as the game information as a function of said at least one of the value and the identity of the products.

2. The checkout terminal according to claim 1, wherein the input means coupled to the processor for entry of data comprises scanning means operable for reading a code on said products identifying said at least one of the value and the identity.

3. The checkout terminal according to claim 1, wherein the processor is operable to choose said indicia to be displayed as a means for indicating a prize to be awarded to a game participant.

4. The checkout terminal according to claim 1, further comprising means for varying a likelihood of winning the prize according to at least one of the value and identity of products presented for purchased.

* * * * *